US010745233B2

(12) United States Patent
Kim et al.

(10) Patent No.: US 10,745,233 B2
(45) Date of Patent: Aug. 18, 2020

(54) POST-PROCESSING APPARATUS AND IMAGE FORMING APPARATUS INCLUDING SAME

(71) Applicant: HEWLETT-PACKARD DEVELOPMENT COMPANY, L.P., Spring, TX (US)

(72) Inventors: Tae-hong Kim, Yongin-si (KR); Kyung-hwan Jang, Hwaseong-si (KR); Hae-seog Cho, Yongin-si (KR)

(73) Assignee: HEWLETT-PACKARD DEVELOPMENT COMPANY, L.P., Spring, TX (US)

( * ) Notice: Subject to any disclaimer, the term of this patent is extended or adjusted under 35 U.S.C. 154(b) by 0 days.

(21) Appl. No.: 16/219,347

(22) Filed: Dec. 13, 2018

(65) Prior Publication Data

US 2019/0112145 A1 Apr. 18, 2019

Related U.S. Application Data

(63) Continuation of application No. 15/503,284, filed on Feb. 10, 2017, now Pat. No. 10,189,667, which is a (Continued)

(30) Foreign Application Priority Data

Aug. 29, 2014 (KR) ..... 10-2014-0114406

(51) Int. Cl.
*B65H 37/04* (2006.01)
*B65H 29/12* (2006.01)
(Continued)

(52) U.S. Cl.
CPC ..... *B65H 37/04* (2013.01); *B65H 29/125* (2013.01); *B65H 29/145* (2013.01); *B65H 31/02* (2013.01);
(Continued)

(58) Field of Classification Search
CPC .... B65H 31/02; B65H 37/04; B65H 2301/36; B65H 2404/531; B65H 2801/27; G03G 15/6541
(Continued)

(56) References Cited

U.S. PATENT DOCUMENTS 589,251 A 8/1897 Elmore
6,702,279 B2 3/2004 Adachi
(Continued)

FOREIGN PATENT DOCUMENTS

CN 101289148 10/2008
CN 102275763 12/2011
(Continued)

*Primary Examiner* — Leslie A Nicholson, III
(74) *Attorney, Agent, or Firm* — Staas & Halsey LLP

(57) ABSTRACT

Disclosed is a post-processing apparatus couplable to an image forming apparatus. The post-processing apparatus comprises: a paper discharging roller to convey, from a conveying path, a first paper discharged from the image forming apparatus, to a standby path connected to the conveying path, and convey the first paper from the standby path and a second paper discharged from the image forming apparatus from the conveying path, to an intermediate loading part, in a state in which a leading end of the first paper toward the intermediate loading part protrudes more than a leading end of the second paper toward the intermediate loading part to process the first paper and the second paper.

20 Claims, 11 Drawing Sheets

Related U.S. Application Data continuation of application No. PCT/KR2015/004334, filed on Apr. 29, 2015.

(51) Int. Cl.

| | |
|---|---|
| ***B65H 29/14*** | (2006.01) |
| ***B65H 31/02*** | (2006.01) |
| ***B65H 31/30*** | (2006.01) |
| ***B65H 33/08*** | (2006.01) |
| ***G03G 15/00*** | (2006.01) |
| ***B65H 31/36*** | (2006.01) |

(52) U.S. Cl.

CPC ..... *B65H 31/3045* (2013.01); *B65H 31/3081* (2013.01); *B65H 31/36* (2013.01); *B65H 33/08* (2013.01); *G03G 15/6541* (2013.01); *G03G 15/6544* (2013.01); *B65H 2301/36* (2013.01); *B65H 2301/4212* (2013.01); *B65H 2301/4213* (2013.01); *B65H 2301/42194* (2013.01); *B65H 2403/942* (2013.01); *B65H 2404/1114* (2013.01); *B65H 2404/166* (2013.01); *B65H 2404/531* (2013.01); *B65H 2405/11151* (2013.01); *B65H 2405/55* (2013.01); *B65H 2408/12* (2013.01); *B65H 2801/27* (2013.01); *G03G 2215/00827* (2013.01)

(58) Field of Classification Search

USPC ..... 270/58.08, 58.11, 58.12, 58.17, 58.27

See application file for complete search history.

(56) References Cited

U.S. PATENT DOCUMENTS

| | | | |
|---|---|---|---|
| 7,165,764 | B2 | 1/2007 | Nakamura |
| 7,461,837 | B2 | 12/2008 | Saito |
| 7,487,959 | B2 | 2/2009 | Noh |
| 7,540,482 | B2 | 6/2009 | Fujii |
| 7,758,033 | B2 | 7/2010 | Terao |
| 7,823,868 | B2 | 11/2010 | Taki |
| 7,896,333 | B2 | 3/2011 | Taki |
| 8,087,654 | B2 | 1/2012 | Awano |
| 8,292,285 | B2 | 10/2012 | Yokoya |
| 8,469,348 | B2 | 6/2013 | Saitsu |
| 8,505,904 | B2 | 8/2013 | Min et al. |
| 8,590,881 | B2 | 11/2013 | Kotani |
| 9,270,849 | B2 | 2/2016 | Takashima |
| 9,302,877 | B2 | 4/2016 | Yasaka |
| 9,703,247 | B2 | 7/2017 | Yamamoto |
| 2006/0071411 | A1 | 4/2006 | Obuchi et al. |
| 2008/0224386 | A1 | 9/2008 | Kunieda |
| 2010/0258995 | A1 | 10/2010 | Okamoto |
| 2014/0300047 | A1 | 10/2014 | Yamamoto |

FOREIGN PATENT DOCUMENTS

| | | |
|---|---|---|
| JP | 2007-22799 | 2/2007 |
| JP | 2009-139808 | 6/2009 |
| JP | 2009-292603 | 12/2009 |
| JP | 2010-168202 | 8/2010 |
| JP | 2010-195523 | 9/2010 |
| JP | 2011-105426 | 6/2011 |
| JP | 2011-201159 | 10/2011 |
| JP | 2012-144326 | 8/2012 |
| JP | 2013-82530 | 5/2013 |
| JP | 2013-216491 | 10/2013 |
| JP | 2014028692 | 2/2014 |
| KR | 10-0405324 | 1/2003 |
| KR | 10-0514280 | 8/2005 |
| KR | 10-0920173 | 6/2009 |
| KR | 10-2011-0021172 | 3/2011 |
| KR | 10-2011-0024562 | 3/2011 |
| KR | 10-2012-0094831 | 8/2012 |

10

POST-PROCESSING APPARATUS AND IMAGE FORMING APPARATUS INCLUDING SAME

CROSS-REFERENCE TO RELATED APPLICATION

This application is a continuation application of U.S. patent application Ser. No. 15/503,284, filed Feb. 10, 2017, which is a U.S. National Stage Application under 35 U.S.C. § 371 of PCT International Application No. PCT/KR2015/004334 filed Apr. 29, 2015, which claims the priority benefit of Korean Patent Application No. 10-2014-0114406, filed on Aug. 29, 2014, in the Korean Intellectual Property Office, the disclosure of which is incorporated herein in its entirety by reference.

TECHNICAL FIELD

Apparatuses and methods consistent with the present invention relate to a post-processing apparatus of an image forming apparatus, and more particularly, to a post-processing apparatus that receives paper from an image forming apparatus capable of performing printing and performs post-processing, such as punching processing or stapling processing, with respect to the paper, and an image forming apparatus including the same.

BACKGROUND ART

In general, a post-processing apparatus is an apparatus that is disposed to be adjacent to an image forming apparatus (e.g., a copier, a printer, or the like) or is disposed inside the image forming apparatus so as to perform a post-processing task, such as stapling or the like, with respect to paper periodically discharged from the image forming apparatus.

A user may preset paper discharged from the image forming apparatus to a paper set including at least 2 or more sheets of paper so as to enable the post-processing apparatus to post-process the paper according to each paper set. The post-processing apparatus continuously compiles conveyed paper to a compiling region and then, if paper is compiled by a preset paper set, immediately performs a post-processing task in the compiling region. If the post-processing task is completed, the post-processing apparatus discharges the post-processed paper set and continuously compiles a next paper set conveyed from the image forming apparatus in the compiling region.

However, if the image forming apparatus discharges paper at a high speed faster than or equal to 50 ppm, the post-processing apparatus does not compile paper that is conveyed in response to a processing speed of the image forming apparatus due to a post-processing task taking a preset time. In order to solve this problem, the post-processing apparatus is to overcome a speed difference from the image forming apparatus by using a method of allowing first paper of each paper set to pre-stand by before a post-processing task of a previous paper set is completed.

If an existing large post-processing apparatus is disposed to be adjacent to an image forming apparatus so as to enable a user to set 2 sheets of paper to one paper set through a method as described above, the existing large post-processing apparatus may operate to a speed corresponding to about 85% of a speed of the image forming apparatus. On the contrary, an existing embedded post-processing apparatus made in a small size does not use a method as described above due to a space restriction. Therefore, if an embedded post-processing apparatus is installed and used inside an image forming apparatus performing high-speed processing, productivity of the embedded post-processing apparatus is lowered.

Also, even if an existing post-processing apparatus complies a plurality of paper sets according to a method of allowing first paper of a paper set to pre-stand by as described above, a skew phenomenon where leading ends of first paper and second paper keep a distance from each other occurs. Therefore, first paper of each paper set is not appropriately stapled to other sheets of paper.

DETAILED DESCRIPTION OF THE INVENTION

Technical Problem

The present invention provides a post-processing apparatus that may be installed inside an image forming apparatus by reducing a volume of a structure allowing first paper to pre-stand by when compiling a plurality of paper sets.

The present invention also provides a post-processing apparatus that prearranges a leading end of first paper of a paper set with leading ends of other paper of the paper set before conveying each paper set to a compiling region.

Technical Solution

According to an aspect of the present invention, a post-processing apparatus includes: a paper discharging roller for conveying both first and second paper sequentially discharged from an image forming apparatus to an intermediate loading part; a paddle part or a main paddle part for conveying the first and second paper loaded on the intermediate loading part to a compiling region; a reverse roller for conveying, together with the main paddle part, the first and second paper to the compiling region, the reverse roller being arranged at a lower side of the main paddle part; and a binding part for processing the first and second paper conveyed to the compiling region. The paper discharging roller may allow the first paper to stand by on a standby path, and convey the first and second paper to the intermediate loading part in a state in which a leading end of the first paper protrudes more than a leading end of the second paper. when the first paper is conveyed to the compiling region by the reverse roller, the main paddle part may stop conveying the second paper for a preset time to arrange the leading ends of the first and second paper.

The main paddle part may include: a drive shaft for rotating together when the reverse roller rotates; at least a pair of first main paddles for being combined with the drive shaft to keep a distance from each other; and at least a pair of second main paddles for being combined with the drive shaft to be disposed respectively close to the pair of first main paddles. The pair of second main paddle may contact the second paper earlier than the pair of first main paddles.

The pair of first main paddles respectively may include a pair of first friction members that are symmetrical to each other, and the pair of second main paddles may respectively include second friction members that are disposed at a preset angle with one of the pair of first friction members.

The pair of first friction members and the second friction members may have different friction coefficients.

The friction coefficients of the second friction members may be lower than the friction coefficients of the pair of first friction members.

The pair of first main paddles and the pair of second main paddles may form the same rotation radius from the drive shaft.

The main paddle part may include: a drive shaft for rotating together when the reverse roller rotates; and at least a pair of main paddles for being combined with the drive shaft to keep a distance from each other. The pair of main paddles may include first and second friction members that are symmetrical to each other and third friction members that are set at a different angle from the first and second friction members.

The third friction members may contact the second paper earlier than the first and second friction members.

The third friction members may have lower friction coefficients than the first and second friction members.

The first through third friction members may have the same rotation radiuses.

The paper discharged from the image forming apparatus may be a paper set that is set to include at least 2 paper, and the first paper is paper of the paper set that is first discharged from the image forming apparatus The paper discharging roller may forwardly and reversely rotate to convey the first paper in an opposite direction of a conveying direction so as to enable the first paper to be positioned on a standby path before the second paper is conveyed from the image forming apparatus.

The post-processing apparatus may further include a guide reverse for being disposed between the conveying path and the standby path connected from the image forming apparatus to the paper discharging roller so as to guide the first paper onto the standby path.

The post-processing apparatus may further include an end fence for arranging back ends of the first and second paper conveyed to the compiling region by the main paddle part and the reverse roller.

The post-processing apparatus may further include an ejector unit for conveying the first and second paper, which are completely post-processed by the binding part, to a final loading part.

The ejector unit may include: guide members for being disposed in a center of the intermediate loading part to be opposite to each other at a preset distance from each other; moving members for being disposed inside the guide members to rotate; a pair of ejector plates for being connected to the guide members, and a pair of grippers for being connected to the moving members.

The binding part may be disposed to be adjacent to the end fence.

The post-processing apparatus may further include a pair of tamper members that are disposed on both sides of the intermediate loading part to be opposite to each other in order to arrange left and right sides of the first and second paper.

The pair of tamper members may arrange the left and right sides of the first and second paper after the leading ends of the first and second paper are arranged.

The pair of tamper members may offset a paper set that is completely post-processed.

According to another aspect of the present invention, a post-processing apparatus for receiving at least two or more paper sets sequentially discharged from an image forming apparatus, and post-processing and discharging the at least two or more paper sets, includes: a paper discharging roller for conveying first paper and second paper of the paper set to an intermediate loading part in a state where leading ends of the first paper and the second paper are not arranged; and a main paddle part and a reverse roller for arranging the leading end of the first paper and leading ends of other paper of the paper set with making a time difference and then conveying the first paper and the other paper to a compiling region for post-processing.

According to another aspect of the present invention, an image forming apparatus includes an image forming apparatus main body; and a post-processing apparatus for being disposed inside the image forming apparatus main body. The post-processing apparatus may include a paper discharging roller for conveying both first and second paper sequentially discharged from the image forming apparatus to an intermediate loading part; and a main paddle part and a reverse roller for conveying the first and second paper loaded on the intermediate loading part to a compiling region. Before the second paper is conveyed from the image forming apparatus, the paper discharging roller may allow the first paper to be positioned on a standby path with gripping a leading end of the first paper so as to convey the first and second paper to the intermediating loading part in a state where the leading end of the first paper protrudes more than a leading end of the second paper.

Advantageous Effects of the Invention

According to the present invention, an additional driving apparatus is not needed except a driving apparatus that forwardly rotates and reversely rotates paper discharging rollers in order to guide first paper of a paper set onto a standby path, which is advantageous to a miniaturization of a post-processing apparatus.

Also, in a post-processing apparatus that operates in response to a processing speed of a high-speed image forming apparatus, a leading end of first paper of a paper set may be completely arranged with leading ends of other paper before the paper set is conveyed to a compiling region. Therefore, an arrangement of paper may be improved when performing compiling processing.

MODE OF THE INVENTION

Hereinafter, a post-processing apparatus according to an exemplary embodiment of the present invention will be described in detail with reference to the attached drawings.

Figure 1:
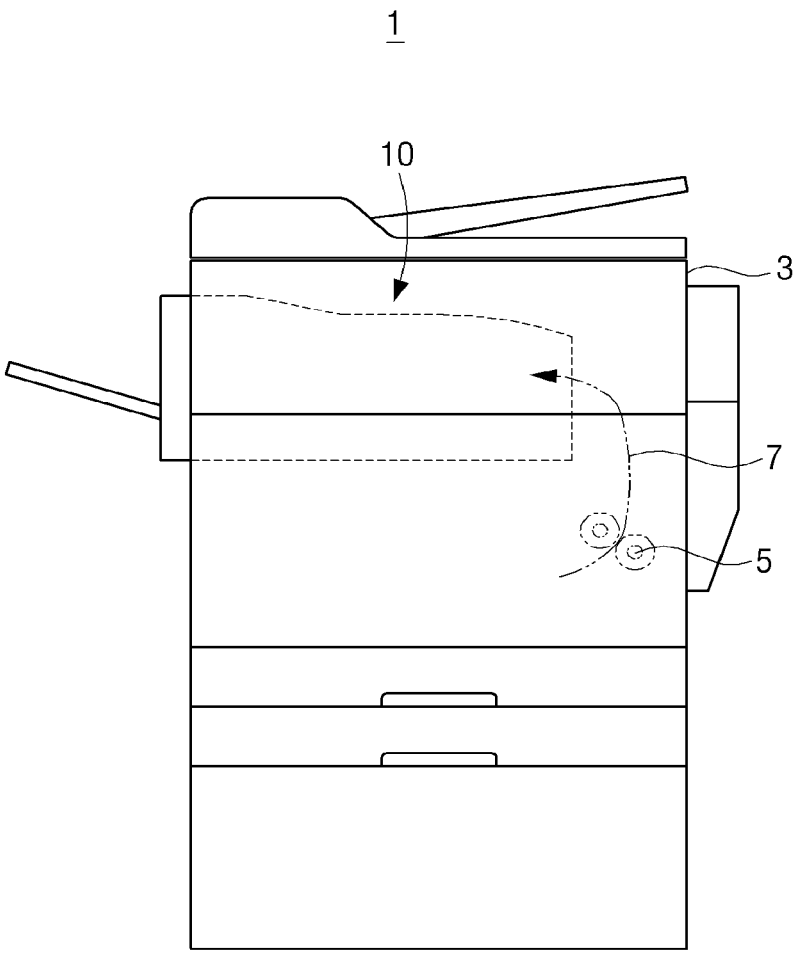
FIG. 1 is a schematic view illustrating an image forming apparatus in which a post-processing apparatus is embedded, according to an exemplary embodiment of the present invention.

Referring to FIG. 1, an image forming apparatus 1 according to an exemplary embodiment of the present invention includes a main body 3, a conveying path 7, conveying rollers 5, and a post-processing apparatus 10 disposed at an internal upper end of the image forming apparatus 1. The conveying rollers 5 of the image forming apparatus 10 sequentially discharges paper, on which printing is completed, to the post-processing apparatus 10 through the conveying path 7.

Figure 2:
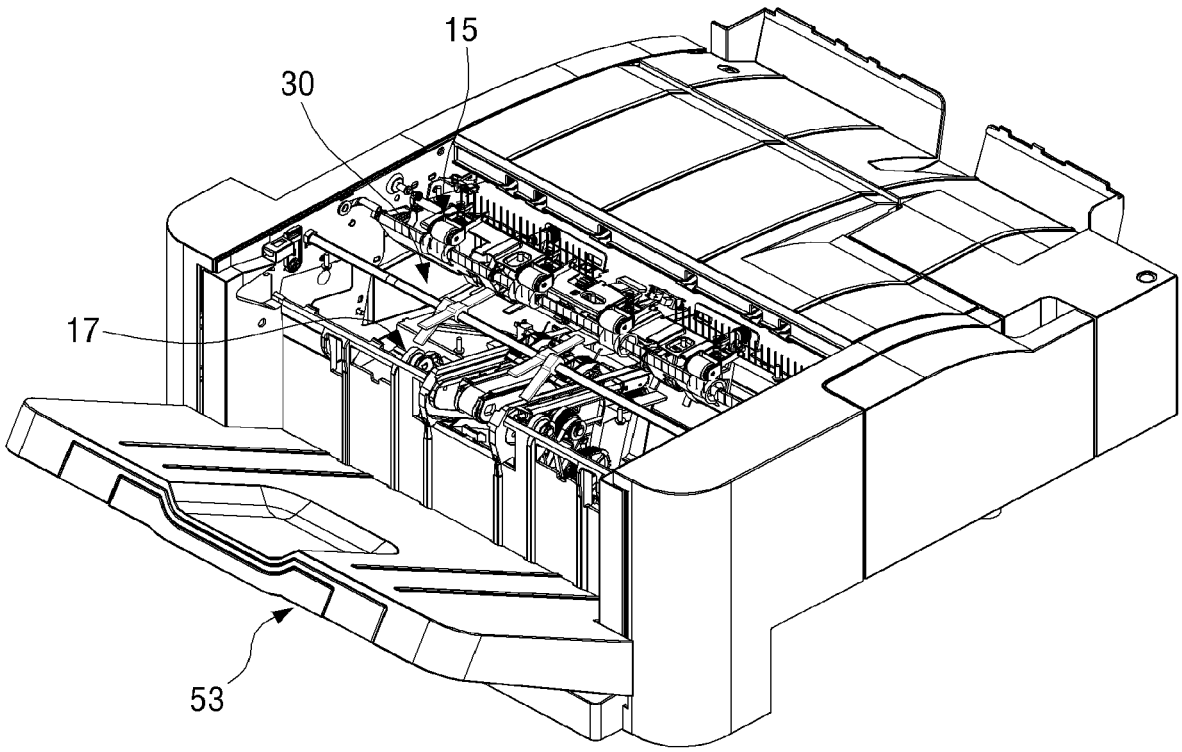
FIG. 2 is a perspective view illustrating a post-processing apparatus according to an exemplary embodiment of the present invention.

Referring to FIG. 2, the post-processing apparatus 10 according to an exemplary embodiment of the present invention is constituted so as to receive paper, which is discharged from the image forming apparatus 1 and on which printing is completed, and selectively perform a punching task, a stapling task of binding a plurality of paper into one, or the like.

As described above, the post-processing apparatus 10 includes first and second conveying rollers 11, paper discharging rollers 15, a conveying path A, a standby path B, reverse rollers 17, a guide reverse 20, a main paddle part 30, an intermediate loading part 51, a sub paddle part 55, an end fence 60, a pair of tamper members 70, a binding part 80, and an ejector unit 90.

Figure 3:
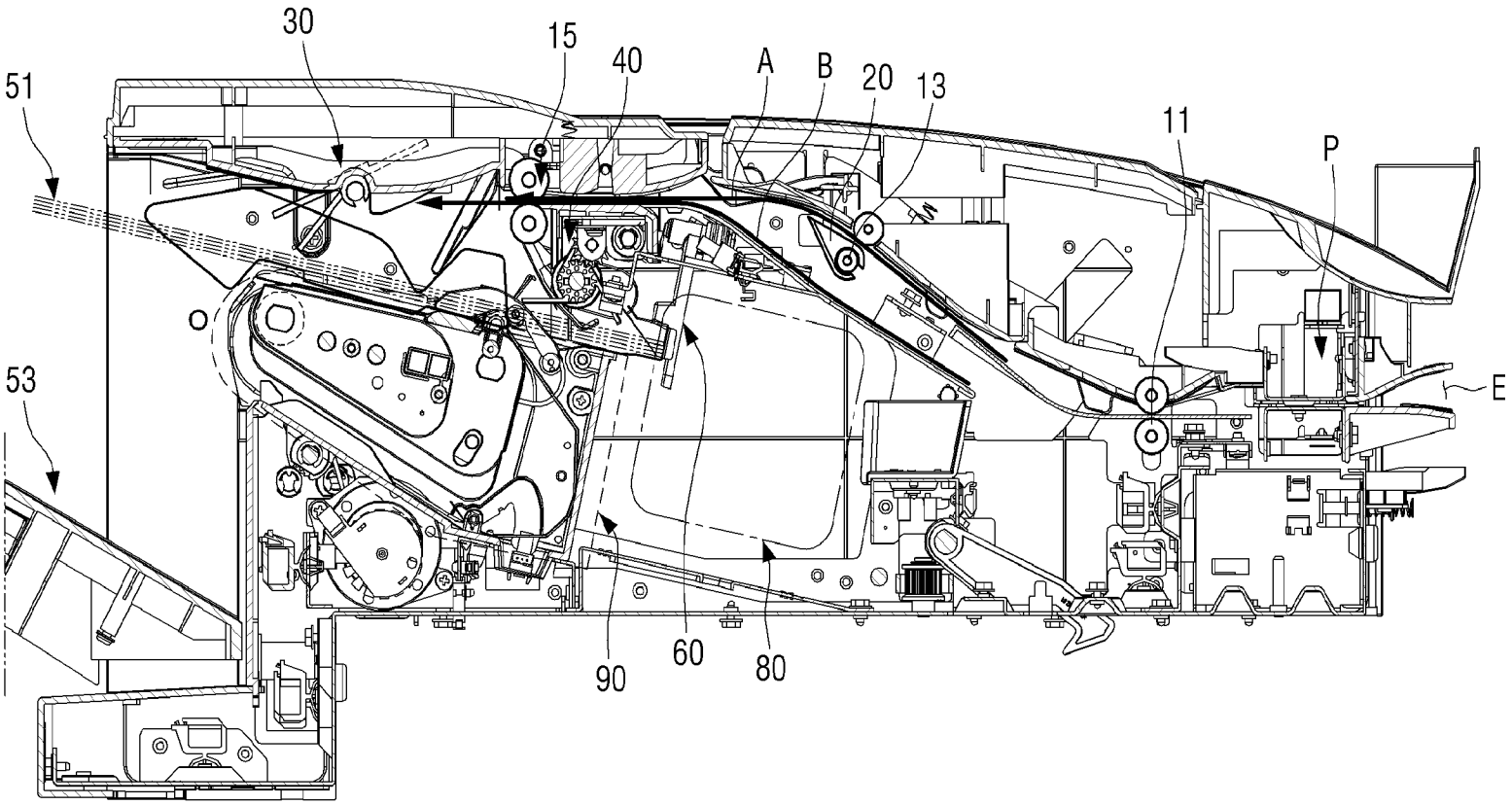
FIG. 3 is a cross-sectional view illustrating the post-processing apparatus shown in FIG. 2.

Referring to FIG. 3, the first conveying rollers 11 are disposed in a position where the conveying path A starts and conveys paper discharged from the first image forming apparatus 1 to the second conveying rollers 13 through the conveying path A. In this case, paper may be punching-processed by a punching part P disposed around an entrance E of the post-processing apparatus 10 before being conveyed to the second conveying rollers 13.

The second conveying rollers 13 are disposed on the conveying path A and conveys paper, which is conveyed from the first conveying rollers 11 through the conveying path A, to the paper discharging rollers 15.

Figure 4:
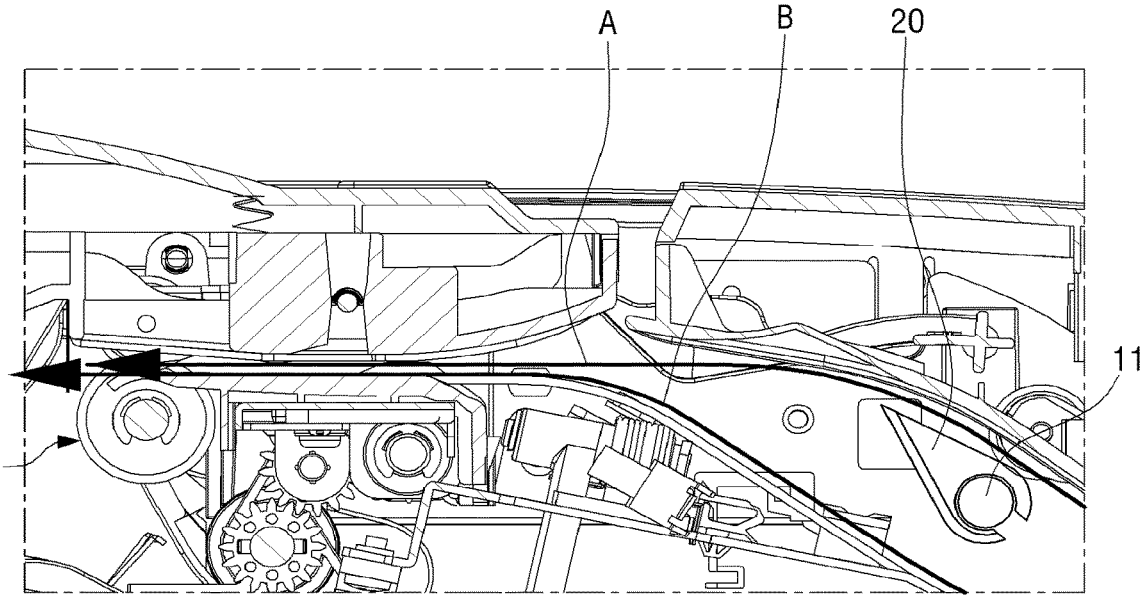
FIG. 4 is an enlarged cross-sectional view illustrating a conveying path, a standby path, a guide reverse, and paper discharging rollers shown in FIG. 3.

Referring to FIG. 4, the paper discharging rollers 15 are disposed a part where the conveying path A ends and forwardly rotates to convey paper, which is conveyed toward the intermediate loading part 51 by the conveying rollers 11, to the intermediate loading part 51. Also, the paper discharging rollers 15 reversely rotate to convey first paper of a paper set to the standby path B so as to allow the first paper to temporarily stand by on the standby path B.

The paper discharging rollers 15 position the first paper on the standby path B with gripping a leading end of the first paper of the paper set and then temporarily stand by until second paper of the paper set is conveying to the paper discharging rollers 15 along the conveying path A. If the second paper is conveyed to the paper discharging rollers 15, the paper discharging rollers 15 forwardly rotates again to convey the second paper to the intermediate loading part 51 together with the first paper. In this case, the first paper is loaded on the intermediate loading part 51 in a state where the leading end of the first paper protrudes a preset length more than a leading end of the second paper.

Also, the paper discharging rollers 15 forwardly rotates so as to continuously convey paper from the second paper of the paper set to last paper of the paper set to the intermediate loading part 51.

The conveying path A is a path that guides paper conveyed into the post-processing apparatus 10 from the entrance E to the paper discharging rollers 15.

The standby path B is a path for allowing paper reaching the paper discharging rollers 15 by the conveying rollers 11 to stand by and is formed to be positioned under the conveying path A and to be incline from the paper discharging rollers 15 toward the entrance E. As described above, paper standing by on the standby path B is first paper of a paper set including the number of paper preset by a user. The reverse rollers 17 keep a distance from the end fence 60 to be disposed on the intermediate loading part 51 in order to compile first and second paper loaded on the intermediate loading part 51 in a compiling region.

Figure 5:
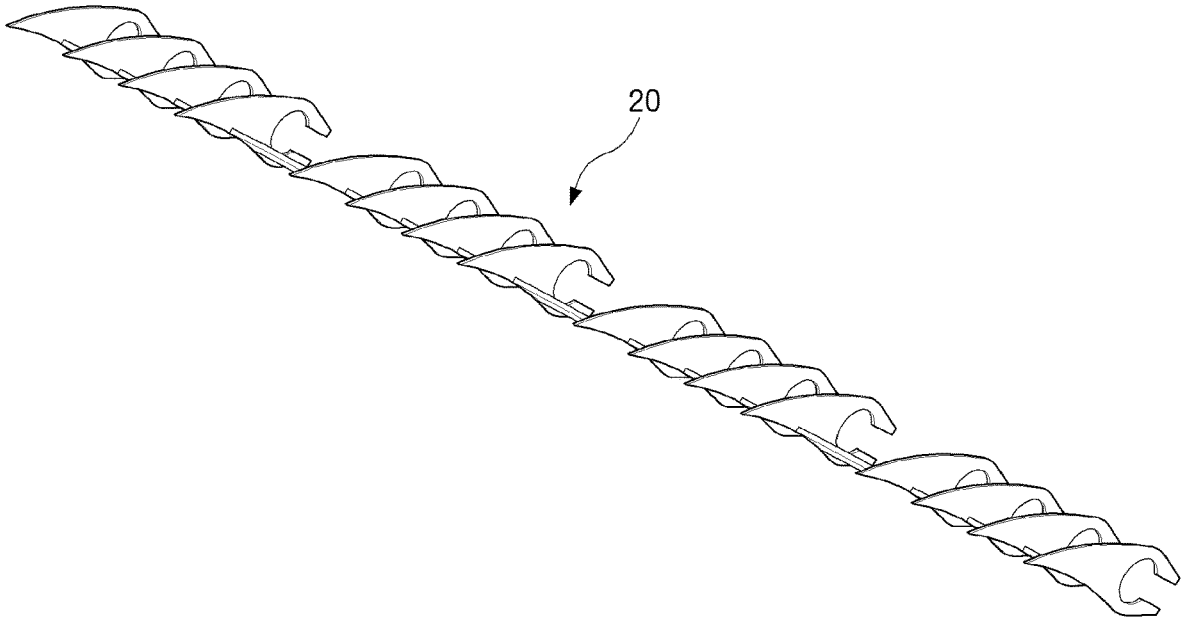
FIG. 5 is a schematic perspective view of the guide reverse of the post-processing apparatus shown in FIG. 4.

Referring to FIGS. 4 and 5, the guide reverse 20 is disposed between the conveying path A and the standby path B and easily guides the first paper of the paper set, which is conveyed by the paper discharging rollers 15 reversely rotating, to the standby path B. The guide reverse 20 guides a back end of the first paper, which sticks to the conveying path A to be conveyed, so as to enable the back end of the first paper to be incline toward the standby path B. Here, the guide reverse 20 is formed in a structure enclosing a lower roller of the second conveying rollers 13 in order to minimize an occupied space.

Figure 6:
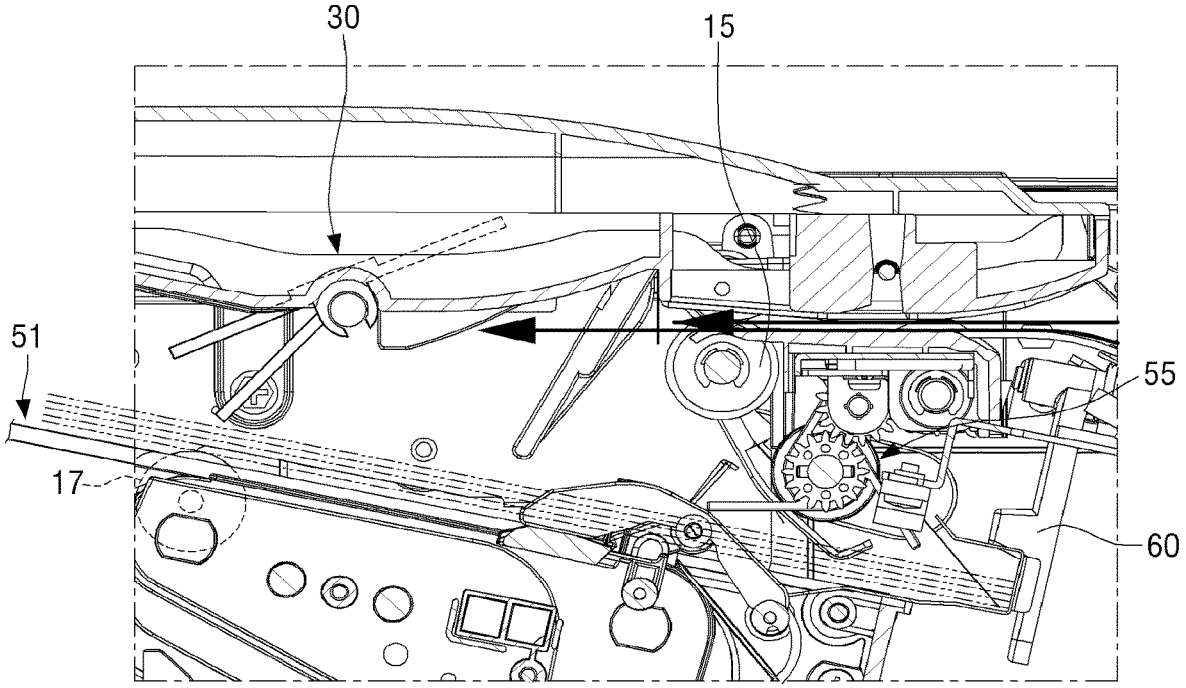
FIG. 6 is a cross-sectional view illustrating a main paddle part, a sub paddle part, the paper discharging rollers, reverse rollers, an intermediate loading part, and a binding part shown in FIG. 3.

Referring to FIG. 6, the main paddle part 30 is disposed to keep a preset distance from an upper surface of the intermediate loading part 51 and conveys the paper set loaded on the intermediate loading part 51 to the compiling region together with the reverse rollers 17.

Figure 7A:
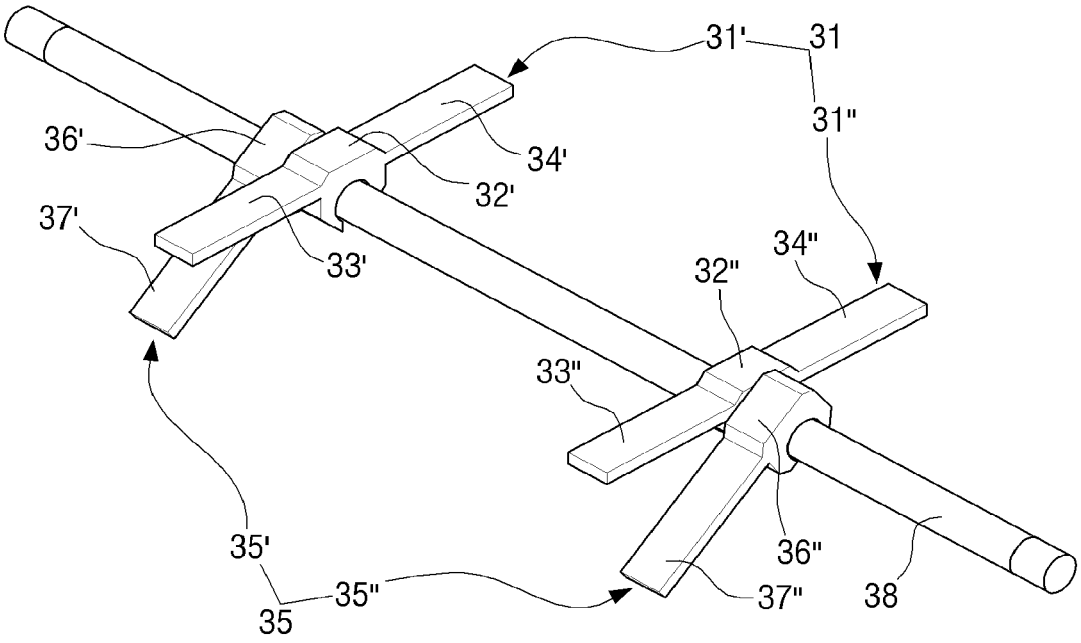
FIG. 7A is a perspective view illustrating the main paddle part shown in FIG. 2.

Referring to FIG. 7A, the main paddle part 30 includes a drive shaft 38 that receives power from a power source (not shown) to rotate, a first main paddle part 31, and a second main paddle part 35.

The first main paddle part 31 includes a pair of first main paddles 31' and 31" that are combined with the drive shaft 38 to keep a distance from each other, and the second main paddle part 35 includes a pair of second main paddles 35' and 35" that are combined with the drive shaft 38 to be respectively adjacent to the pair of first main paddles 31' and 31".

The pair of first main paddles 31' and 31" respectively include a pair of first fixing members 32" and 32" that are symmetrical to each other to be combined with the drive shaft 38 and first friction members 33', 34', 33", and 34" that are combined with the first fixing members 32' and 32".

The pair of second main paddles 35' and 35" respectively includes a pair of second fixing members 36' and 36" that are combined with the drive shaft 38 and a pair of friction members 37' and 37" that are disposed at a preset angle with one of the pair of first fixing members 33', 34', 33", and 34" and combined with a pair of second fixing members 36' and 36".

The pair of first main paddles 31' and 31" and the pair of second main paddles 35' and 35" rotate on the same drive shaft 38. In this case, the pair of second main paddles 35' and 35" contact the paper set loaded on the intermediate loading part 51 earlier than the pair of first main paddles 31' and 31". For this, the pair of first friction members 33', 34', 33", and 34" and the pair of second friction members 37' and 37" are respectively disposed at different angles.

Therefore, while the reverse rollers 17 rotates to convey a paper set to the compiling region, the pair of second friction members 37' and 37" temporarily stop the paper set for a preset time so as to allow merely first paper disposed on a lowermost part of the paper set to be conveyed to the compiling region through the reverse rollers 17. In this case, the pair of second friction members 37' and 37" stop the paper set to a point of time when the leading end of the first paper is arranged with leading ends of other paper of the paper set.

The paper set is conveyed to the compiling region by the pair of first friction members 33' 34', 33", and 34" and the reverse rollers 17 when the leading ends are arranged as described above.

In this case, the pair of first friction members 33', 34', 33", and 34" and the pair of second friction members 37' and 37" have different friction coefficients and may be constituted so as to enable the friction coefficients of the second friction members 37' and 37" to be lower than the friction coefficients of the pair of first friction members 33' 34' 33", and 34". This is an action for conveying the first paper disposed on a lowermost side of the paper set through the reverse rollers 17 when the pair of second friction members 37' and 37" grip the paper set to stop the paper set for a preset time.

In addition, the pair of first main paddles 31' and 31" and the pair of second main paddles 35' and 35" are constituted to form the same rotation radius from the same drive shaft 38.

Figure 7B:
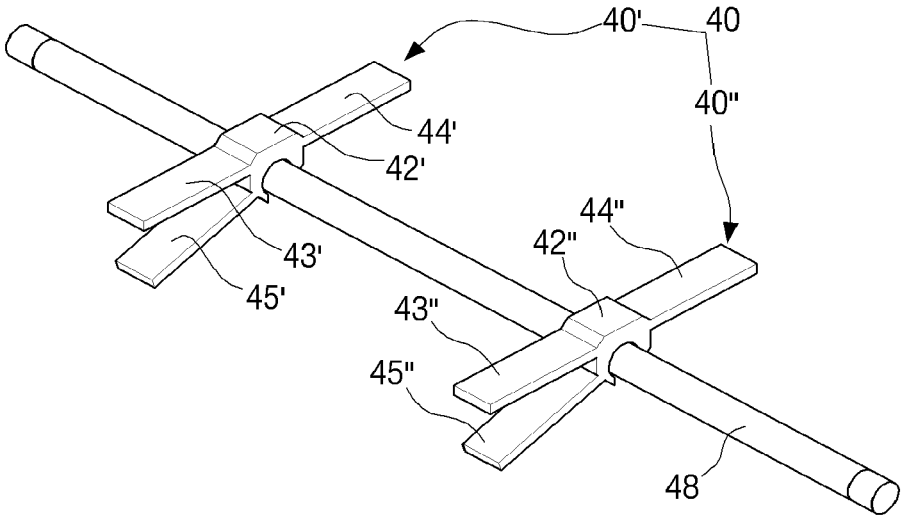
FIG. 7B is a perspective view illustrating another example of the main paddle part.

Referring to FIG. 7B, a main paddle part 40 according to another exemplary embodiment may include first and second main paddles forming a single body differently from the main paddle part 30 shown in FIG. 7A.

The main paddle part 40 may include a pair of main paddles 40' and 40" that are combined with a drive shaft 48 to keep a distance from each other. The pair of main paddles 40' and 40" may respectively include first friction members 43' and 43" and second friction members 44' and 44" that are symmetrical to each other, and third friction members 45' and 45" that are set at different angles from the first friction members 43' and 43" and the second friction members 44' and 44".

The third friction members 45' and 45" are constituted so as to contact the second paper earlier than the first friction members 43' and 43" and the second friction members 44' and 44". The third friction members 45' and 45" are formed to have friction coefficients lower than the first friction members 43' and 43" and the second friction members 44' and 44".

The first friction members 43' and 43", the second friction members 44' and 44", and the third friction members 45' and 45" are constituted to have the same rotation radius from the same drive shaft 48.

Referring to FIG. 6 again, the intermediate loading part 51 loads the paper set conveyed by the paper discharging rollers 15. In this case, in the intermediate loading part 51, a leading end of the paper set is arranged by the reverse rollers 17 and the pair of second main paddles 35 before the paper set is conveyed to the compiling region.

Also, the intermediate loading part 51 is disposed to incline toward the compiling region so as to load paper discharged from the paper discharging rollers 15 and then easily compile the paper to the compiling region and keeps a distance from the paper discharging rollers 15 toward a lower part of the post-processing apparatus so as to easily discharge the paper from the paper discharging rollers 15 without a clash with a side of the paper set discharged from the paper discharging rollers 15 and having a preset height although the paper set is loaded on the intermediate loading part 51.

Figure 8:
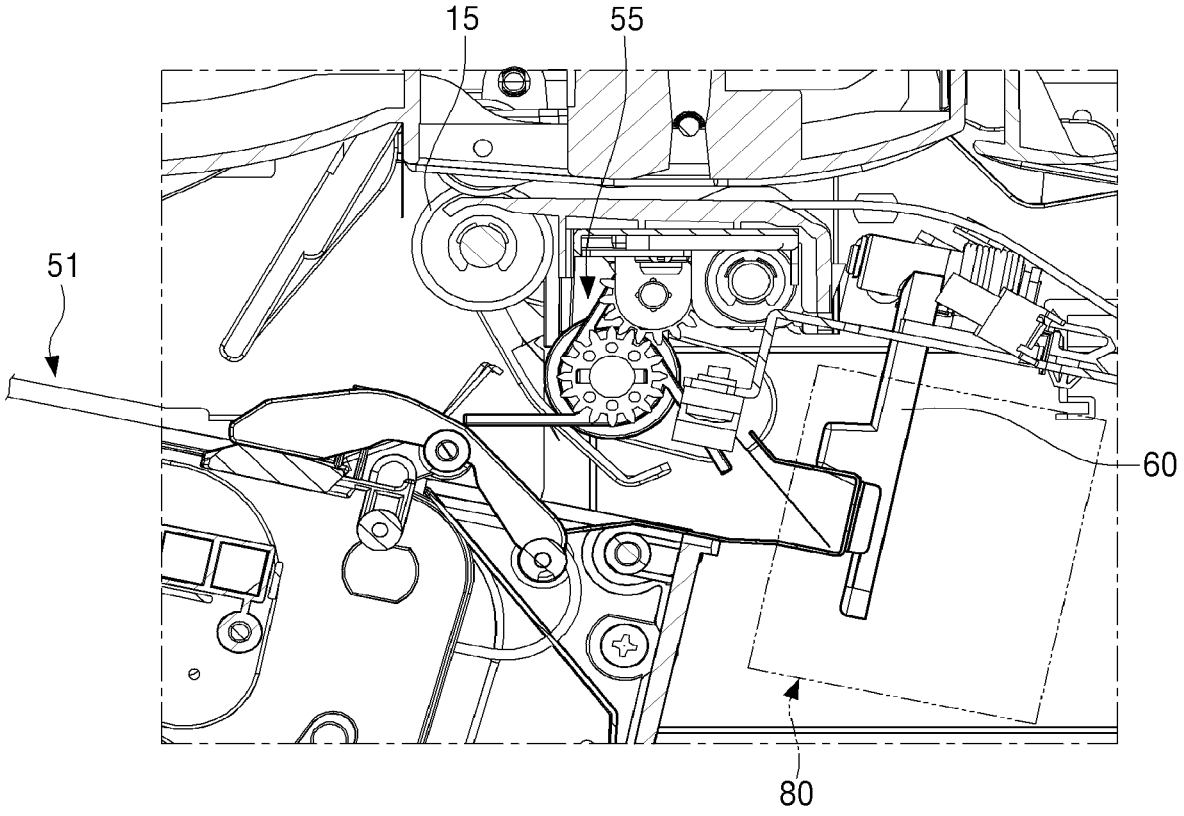
FIG. 8 is a cross-sectional view illustrating the paper discharging rollers, an end fence, a sub paddle part, and the binding part shown in FIG. 3.

Referring to FIG. 8, a sub paddle part 55 keeps a distance from the intermediate loading part 51 to be disposed between the main paddle part 30 and the reverse rollers 17 and the end fence 60. The sub paddle part 55 enables a back end of the paper set conveyed by the first main paddle 31 and the reverse rollers 17 to stick to the end fence 60 so as to arrange the paper set.

Figure 9:
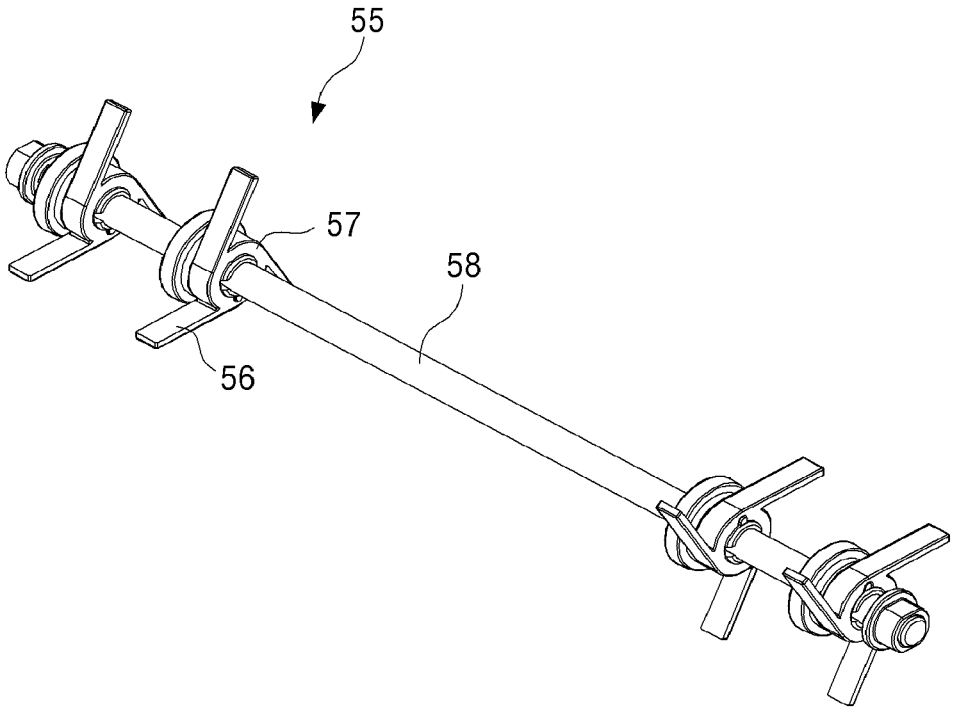
FIG. 9 is a perspective view illustrating the sub paddle part shown in FIG. 3.

Referring to FIG. 9, the sub paddle part 55 includes a drive shaft 58, fixing members 57 fixed to the drive shaft 58, and a plurality of friction members 56 formed at the fixing members 57.

The fixing members 57 are formed in circular plate shapes having preset thicknesses, and holes are formed in the fixing members 57 so as to enable the drive shaft 58 to pass through the holes. The plurality of friction members 56 extend from outer surfaces of the fixing members 57 toward tangential directions of the fixing members 57 with keeping preset distances toward a circumferential direction of the fixing members 57.

The end fence 60 is disposed at an end of the intermediate loading part 51 so as to enable a back end of paper conveyed to the intermediate loading part 51 to contact the end fence 60 and to be arranged and thus enable a binding part to easily perform a processing operation, such as stapling, binding, or the like.

The compiling region may be defined as an area enclosed by the intermediate loading part 51 and the end fence 60.

Figure 10:
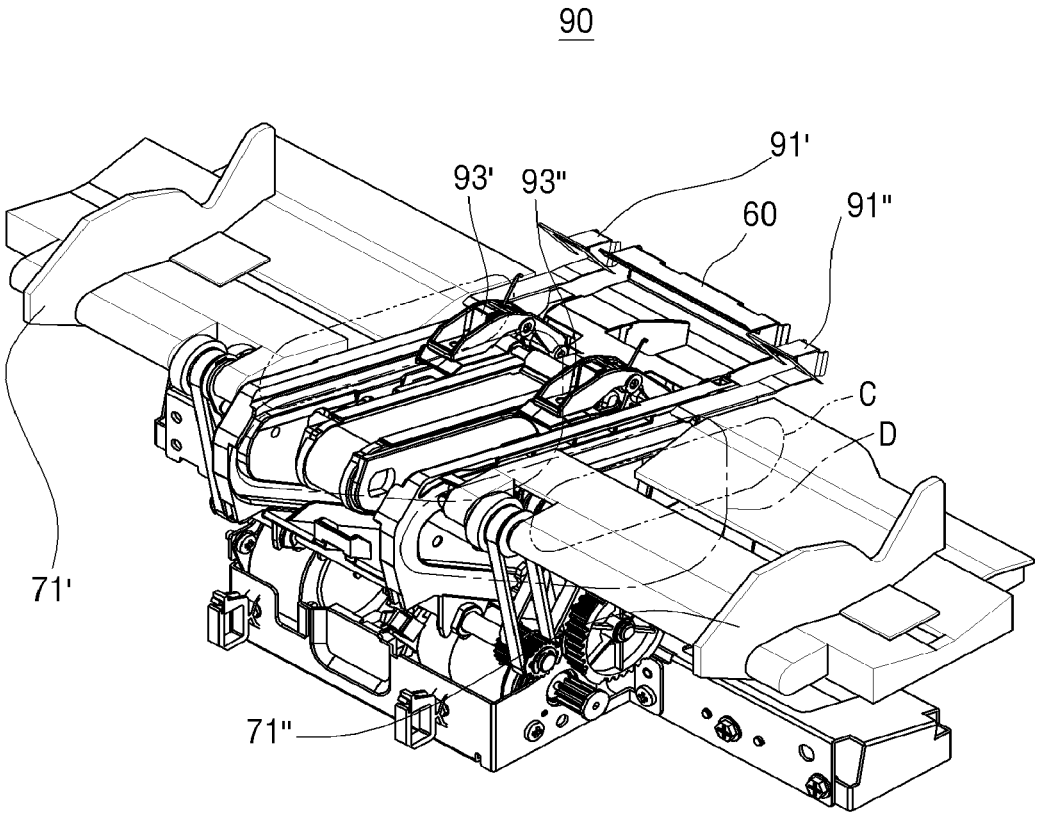
FIG. 10 is a perspective view illustrating an ejector unit shown in FIG. 3.

Referring to FIG. 10, the pair of tamper member 71' and 71" are disposed on both sides of the intermediate loading part 51 to be opposite to each other in order to arrange the paper set loaded on the intermediate loading part 51 in left and right directions. The tamper members 71' and 71" are arranged in an advancing direction of paper by the main paddle part 30 and the reverse rollers 17 and then repeatedly move to positions designated by the user to arrange the first and second paper in left and right directions.

The binding part 80 includes a binding apparatus, a stapler, and the like to perform post-processing, such as stapling and the like at the end fence 60 disposed at the end of the intermediate loading part 51, with respect to paper whose back end is arranged at the end fence 60, and is disposed to be adjacent to the end fence 60.

The ejector unit 90 includes guide members (not shown) that are disposed in a center of the intermediate loading part 51 to be opposite to each other at a preset distance from each other, moving members (not shown) that are arranged inside the guide members to be opposite to each other so as to rotate with drawing a preset trajectory, a pair of ejector plates 91' and 91" that are connected to the guide members, and a pair of grippers 93' and 93" that are connected to the moving members. The pair of ejector plates 91' and 91" are disposed on both sides of the end fence 60 and move the paper set, which is arranged at the end fence 60 by the guide members, to an intermediate point of the intermediate loading part 51 along a movement path D through which the guide members move.

The pair of grippers 93' and 93" that are connected to the moving members grip the back end of the paper set moved to the intermediate point of the intermediate loading part 51 and discharge the paper set to a last loading part 53 with drawing a preset trajectory along the movement path C of the moving members. The pair of grippers 91' and 91" grip paper sets to drop the paper sets at a low height from the last loading part 53 and thus has a higher arrangement than when the paper sets are dropped by the pair of ejector plates 91' and 91".

Operations of the post-processing apparatus 10 constituted as described above will be sequentially described with reference to the drawings. Hereinafter, for convenience of description, a paper set will be described as being set to include 2 paper.

The user may preset paper discharged from the image forming apparatus 1 to a paper set including at least 2 or more paper so as to enable the post-processing apparatus to post-process paper according to each paper set.

Referring to FIGS. 3 and 4, first paper of a paper set discharged from the image forming apparatus 1 is moved into the post-processing apparatus 10 through the entrance E of the post-processing apparatus 10 and starts to be conveyed to the second conveying rollers 13 through the conveying path A by the first conveying rollers 11.

Here, if the user presets a punch mode, the first paper is punch-processed by the punching part P and then starts to be conveyed through the conveying path A by the first conveying rollers 11 so as to be conveyed to the second conveying rollers 13.

The first paper conveyed to the paper discharging rollers 15 is not immediately discharged to the intermediate loading part 51, but a conveying direction of the first paper is changed by the paper discharging rollers 15 until post-processing is completed with respect to a paper set previously compiled to the compiling region.

The first paper whose conveying direction is changed is not guided to the conveying path A but is guided to and standby on the standby path B by the guide reverse 20. The guide reverse 20 is formed in a structure enclosing a lower roller of the second conveying rollers 13 to stick to the conveying path A so as to minimize a space occupied by the guide reverse 20 and naturally guide the first paper onto the standby path B. Here, the paper discharging rollers 15 do not completely discharge the first paper from the paper discharging rollers 15 to the standby path B but stands by with gripping a leading end of the first paper until second paper of the paper set is conveyed from the image forming apparatus 1 to the paper discharging rollers 15, so as to re-discharge the first paper to the intermediate loading part 51.

The second paper discharged from the image forming apparatus 1 is conveyed to the paper discharging rollers 15 through the conveying path A by the first and second conveying rollers 11 and 13. Here, a paper set that is previously compiled is completely post-processed and then discharged to the last loading part 53 by the ejector unit 90.

The paper discharging rollers 50 forwardly rotate when a leading end of the second paper reaches the paper discharging rollers 15, to discharge the first paper, which is gripped thereby, together with the second paper reaching the paper discharging rollers 15 to the intermediate loading part 51. In this case, when the leading end of the second paper reaches the paper discharging rollers 15, the paper discharging rollers 50 discharge the first and second paper, whose leading ends are gripped, to the intermediate loading part 51. Therefore, the first paper is loaded on the intermediate loading part in a state where the leading end of the first paper protrudes more than the leading end of the second paper.

The first paper and the second paper loaded on the intermediate loading part 51 are compiled to a compiling region (not shown), which is enclosed by the intermediate loading part 51 and the end fence 60, by rotations of the first main paddle 30 and the reverse rollers 17.

The first main paddle 31 of the main paddle part 30 contacts the second paper positioned on the first paper to compile the first and second paper to the compiling region, and the reverse rollers 17 contact the first paper positioned underneath the second paper to compile the first paper and the second paper to the compiling region.

Before conveying the paper set to the compiling region, the leading ends of the first and second paper are arranged by the second main paddle 35 and the reverse rollers 17. In other words, the second main paddle 35 of the main paddle part 30 contacts the second paper earlier than the first main paddle 31. Therefore, the friction members 37' and 37" of the second main paddle 35 pressurize the second paper in a direction facing the reverse rollers 17 for a preset time when the reverse rollers 17 perform compiling.

The friction members 37' and 37" of the second main paddle 35 that contact the second paper have lower friction coefficients than the friction members 33', 33", 34', and 34" of the first main paddle 31. Therefore, the second paper contacting the friction members 37' and 37" of the second main paddle 35 is temporarily stopped, and the first paper disposed underneath the second paper is conveyed to the compiling region by the reverse rollers 17. Therefore, the leading end of the first paper is arranged with the leading end of the second paper.

At a point of time when the leading ends of the first and second paper are arranged, the second paper is released from being stopped ty the second main paddle 35 and conveyed to the compiling region together with the first paper by the friction members 33' 33", 34', and 34" of the first main paddle 31 and the reverse rollers 17.

The first main paddle 31 compiles the first paper and the second paper two times when the first main paddle 31 rotates on a drive shaft one time by the pairs of first friction members 33', 33", 34', and 34" disposed to be symmetrical to each other based on the fixing members 32' and 32". As described above, the post-processing apparatus 10 of the present exemplary embodiment lowers the number of compiling operations to two times in order to prevent an arrangement from being lowered or paper from being jammed due to an excessively sticking to the compiling region.

The sub paddle part 55 enables the paper set compiled by the first main paddle 31 and he reverse rollers 17 to stick to the end fence 60 so as to arrange back ends of the first and second paper.

As shown in FIG. 10, the first and second paper whose back ends are arranged at the end fence 60 are completely arranged to left and right by the pair of tamper members 71' and 71" moving to a point designated by the user. Sequentially, a paper set completely arranged to left and right by a pair of tamper members stands by so as to be stapling-processed, binding-processed, or the like by the biding part 80 with being arranged at the end fence 60.

If the user sets at least 3 paper to one paper set, from paper after third paper of the paper set that is set by the user, each of the at least 3 paper is immediately loaded on the intermediate loading part 51 through the conveying path A to be compiled to the compiling region by the first main paddle 31 without an operation of standing by on the standby path B. Therefore, an arrangement process that is performed in an advancing direction of paper with respect of first and second paper is not applied from the paper after the third paper of the paper set.

Referring to FIG. 10, a paper set that is completely arranged is post-processed, such as stapling, binding, or the like, by the binding part 80 according to a selection of the user. Thereafter, the paper set moves to the intermediate point of the intermediate loading part 51 by the pair of the ejector plates 91' and 91" moving along the movement path D of the guide members. The paper set that is moved to the intermediate point is gripped by a pair of grippers 93' and 93" moving along the movement path C of the moving members to be moved to a position close to the final loading part 53 and then discharged to the last loading part 53.

If offset is performed according to paper sets, the pair of tamper members 71' and 71" move to a point preset by the user so as to enable a paper set to be offset. A plurality of paper sets are sequentially arranged to left and right through this process, discharged to the final loading part 53 by the ejector unit 90, and loaded in an offset state.

According to the present invention as described above, an additional driving apparatus is not be needed except a driving apparatus that forwardly and reversely rotates paper discharging rollers in order to guide first paper of a paper set onto a standby path, which is advantageous to a miniaturization of a post-processing apparatus.

Also, in a post-processing apparatus that operates in response to a processing speed of a high-speed image forming apparatus, before a paper set is conveyed to a compiling region, leading ends of first paper and other paper of the paper set may be completely arranged, and thus an arrangement of paper may be improved when performing compiling-processing.

[01] The foregoing exemplary embodiments and advantages are merely exemplary and are not to be construed as limiting the present invention. The present teaching can be readily applied to other types of apparatuses. Also, the description of the exemplary embodiments of the present invention is intended to be illustrative, and not to limit the scope of the claims, and many alternatives, modifications, and variations will be apparent to those skilled in the art.

The invention claimed is:

1. A post-processing apparatus couplable to an image forming apparatus comprising:

a paper discharging roller to:

convey, from a conveying path, a first paper discharged from the image forming apparatus, to a standby path connected to the conveying path, and convey the first paper from the standby path and a second paper discharged from the image forming apparatus from the conveying path, to an intermediate loading part, in a state in which a leading end of the first paper toward the intermediate loading part protrudes more than a leading end of the second paper toward the intermediate loading part, to prearrange in the intermediate loading part the first paper and the second paper in the state before post-processing the first paper and the second paper.

2. The post-processing apparatus of claim 1, further comprising a paddle part;

a reverse roller; and a post-processing part, wherein the paddle part and the reverse roller is to convey the first paper and the second paper conveyed to the intermediate loading part and prearranged in the state, to a compiling region, to compile the first paper and the second paper;

the post-processing part is to process the first paper and the second paper conveyed to the compiling region, and when the reverse roller is to convey the first paper to the compiling region, the paddle part is to stop conveying the second paper for a time period to align the leading end of the first paper and the leading end of the second paper.

3. The post-processing apparatus of claim 2, wherein the paddle part includes:

a drive shaft to rotate;

a first paddle coupled to the drive shaft; and a second paddle coupled to the drive shaft to be adjacent to the first paddle, wherein the second paddle is to contact the second paper earlier than first paddle.

4. The post-processing apparatus of claim 3, wherein the first paddle includes a pair of first friction members that are symmetrical to each other, and the second paddle includes a second friction member that is disposed at a preset angle with a first friction member of the pair of first friction members.

5. The post-processing apparatus of claim 4, wherein friction coefficients of the pair of first friction members are different from a friction coefficient of the second friction member.

6. The post-processing apparatus of claim 3, wherein the first paddle and the second paddle form a same rotation radius from the drive shaft.

7. The post-processing apparatus of claim 2, wherein the paddle part includes:

a drive shaft; and a paddle coupled to the drive shaft, wherein the paddle includes a first friction member a second friction member symmetrical to the first friction member, and a third friction member that is disposed at an angle with the first friction member and the second friction member.

8. The post-processing apparatus of claim 7, wherein the third friction member is to contact the second paper earlier than the first friction member and the second friction member.

9. The post-processing apparatus of claim 8, wherein the third friction member has a lower friction coefficient than friction coefficients of the first and second friction members.

10. The post-processing apparatus of claim 7, wherein the first friction member, the second friction member and the third friction member have a same rotation radius.

11. A post-processing apparatus to receive a first paper and a second paper sequentially discharged from an image forming apparatus, the post-processing apparatus comprising:

a paper discharging roller to convey the first paper and the second paper to an intermediate loading part in a state where a leading end of the first paper toward the intermediate loading part is apart from a leading end of the second paper toward the intermediate loading part; and a paddle part and a reverse roller to:

move the leading end of the first paper conveyed to the intermediate loading part and the leading end of the second paper conveyed to the intermediate loading part, toward a compiling region at different timings, to align the leading end of the first paper and the leading end of the second paper, and convey the first paper and the second paper to the compiling region, to post-process the first paper and the second paper.

12. The post-processing apparatus of claim 11, wherein when the reverse roller conveys the first paper to the compiling region, the paddle part is to stop conveying the second paper for a preset time period to align the leading end of the first paper and the leading end of the second paper.

13. The post-processing apparatus of claim 11, wherein the paddle part includes a first paddle and a second paddle, the first paddle and the second paddle are to rotate together with the reverse roller, and the second paddle is disposed at an angle with the first paddle, so as to contact the first paper or the second paper earlier than the first paddle.

14. The post-processing apparatus of claim 13, wherein the first paddle includes a first friction member and the second paddle includes a second friction member, and wherein the second friction member of the second paddle has a different friction coefficient from a friction coefficient of the first friction member of the first paddle.

15. The post-processing apparatus of claim 1, further comprising a guide reverse disposed between the conveying path and the standby path, to guide the first paper conveyed from the conveying path to the standby path.

16. The post-processing apparatus of claim 2, further comprising an end fence to arrange back ends of the first and second papers respectively opposite to the leading ends of the first and second papers conveyed to the compiling region.

17. The post-processing apparatus of claim 2, further comprising a pair of tamper members respectively disposed on both sides of the intermediate loading part to be opposite to each other, the pair of tamper members to arrange left and right sides of the first and second papers.

18. The post-processing apparatus of claim 11, wherein the paddle part includes:

a drive shaft; and a paddle coupled to the drive shaft, the paddle includes a first friction member, a second friction member symmetrical to the first friction member, and a third friction member that is disposed at an angle with the first friction member and the second friction member.

19. The post-processing apparatus of claim 11, further comprising an end fence to arrange back ends of the first and second papers respectively opposite to the leading ends of the first and second papers conveyed to the compiling region.

20. The post-processing apparatus of claim 11, further comprising a pair of tamper members respectively disposed on both sides of the intermediate loading part to be opposite to each other, the pair of tamper members to arrange left and right sides of the first and second papers.

* * * * *